US005806454A

United States Patent [19]

McKiernan et al.

[11] Patent Number: 5,806,454

[45] Date of Patent: Sep. 15, 1998

[54] DISCHARGE HOSE ADAPTER FOR BOAT HOLDING TANK

[75] Inventors: Edward McKiernan, Big Prairie; James A. Sigler, Perrysville; William J. Friedman, Wooster, all of Ohio

[73] Assignee: Sealand Technology, Inc., Big Prairie, Ohio

[21] Appl. No.: 701,726

[22] Filed: Aug. 22, 1996

[51] Int. Cl.[6] ..... B63B 35/00

[52] U.S. Cl. ..... 114/270; 4/321; 285/119; 285/139.1; 285/915

[58] Field of Search ..... 285/12, 119, 148.23, 285/903, 423, 915, 239, 21.3, 139.1; 114/270; 4/321

[56] References Cited

U.S. PATENT DOCUMENTS

| | | | |
|---|---|---|---|
| 3,528,462 | 9/1970 | Quase | 141/285 |
| 3,820,488 | 6/1974 | Johnson | 114/270 |
| 4,133,347 | 1/1979 | Mercer | 285/402 X |
| 4,484,769 | 11/1984 | Lacey | 285/239 X |
| 4,554,949 | 11/1985 | Sell | 285/423 X |
| 4,688,833 | 8/1987 | Todd | 285/12 |
| 4,690,434 | 9/1987 | Schmidt | 285/423 X |
| 4,708,370 | 11/1987 | Todd | 285/903 X |
| 4,758,027 | 7/1988 | Todd | 285/423 X |
| 5,333,910 | 8/1994 | Bailey | 285/12 X |
| 5,335,943 | 8/1994 | Duryea | 285/239 X |
| 5,336,351 | 8/1994 | Meyers | 285/21.3 |
| 5,433,163 | 7/1995 | McKiernan . | |

*Primary Examiner*—Dave W. Arola
*Attorney, Agent, or Firm*—Nixon & Vanderhye P.C.

[57] ABSTRACT

A discharge hose adapter adapts a standard marine thru hull fitting to a standard sanitation hose enabling discharge of a boat holding tank into a dump station. The adapter preferably includes a first component and a second component. The first end of the first component is frictionally engageable with the standard marine thru hull fitting, a first end of the second component is engageable with the second end of the first component, and a second end of the second component is engageable with the sanitation hose. The first component is preferably PVC injection molded plastic, and the second component is preferably compression molded rubber derived from vinyl monomers.

18 Claims, 2 Drawing Sheets

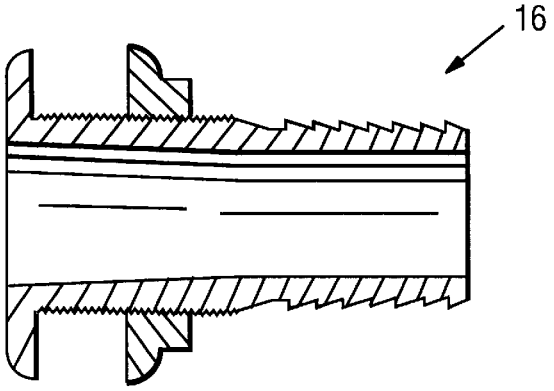
Fig. 2
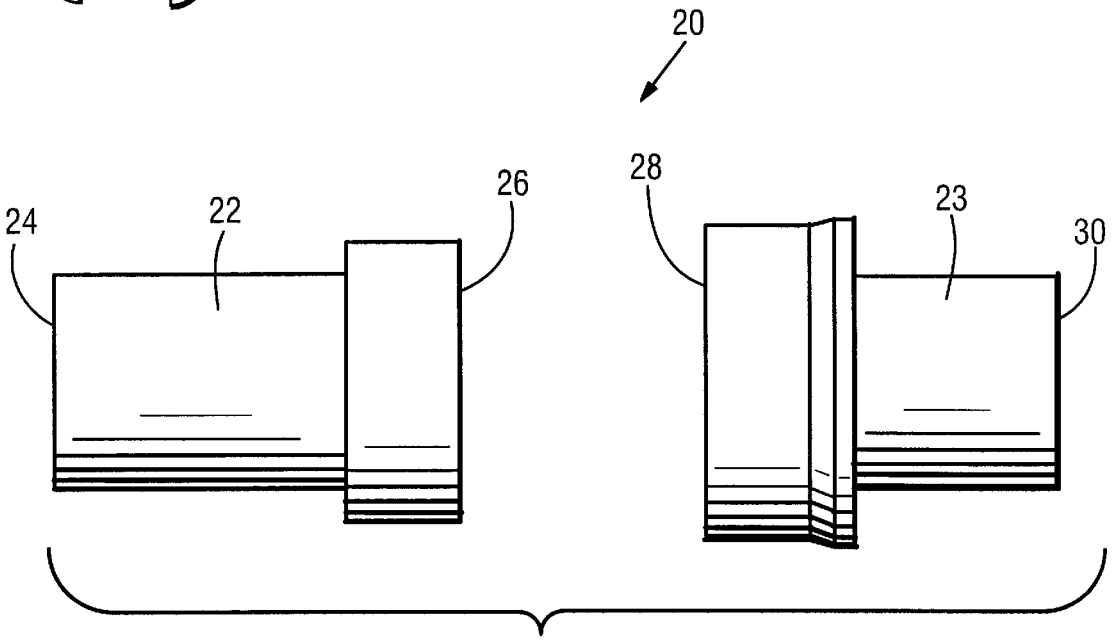
Fig. 3
Fig. 4
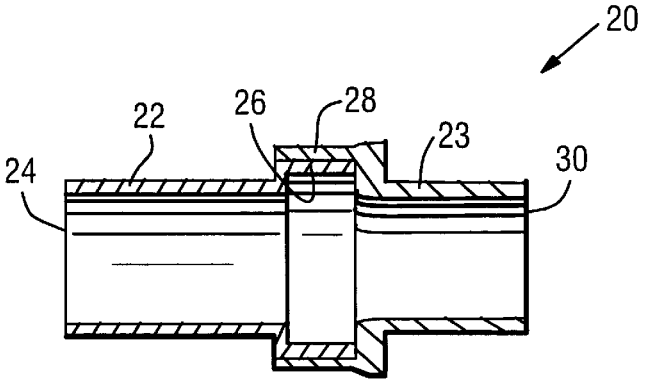

DISCHARGE HOSE ADAPTER FOR BOAT HOLDING TANK

BACKGROUND AND SUMMARY OF THE INVENTION

The present invention relates to a discharge hose adapter for a boat holding tank and, more particularly, to a discharge hose adapter that adapts a standard thru hull fitting to a standard sanitation hose, enabling discharge of the boat holding tank into a dump station.

Emptying a holding tank on a small trailerable boat can be expensive and inconvenient. A pump out station may not be in the vicinity of the loading ramp, thus making the process of emptying the holding tank time consuming. Moreover, many trailer boats are used on fresh water lakes where overboard discharge is prohibited.

According to the present invention, there is provided a discharge hose adapter for a boat holding tank including structure for adapting a standard marine thru hull to a standard sanitation hose, enabling discharge of the boat holding tank into a dump station. The adapting structure preferably includes structure for frictionally engaging the standard marine thru hull fitting.

In accordance with another aspect of the invention, there is provided a discharge hose adapter for a boat holding tank that includes a first component having a first end and a second end, wherein the first end is frictionally engageable with a standard marine thru hull fitting; and a second component having a first end engageable with the second end of the first component and a second end engageable with a sanitation hose.

The first component is preferably PVC injection molded and may be press fittable with the marine thru hull fitting. In accordance with a preferred embodiment, the first end is frictionally engageable with a standard 1½ inch marine thru hull fitting. Still further, the first end is preferably frictionally engageable with the standard marine thru hull fitting to remain secure to at least 18 psi of back pressure.

The second component is preferably compression molded rubber derived from vinyl monomers and is preferably bonded to the first component. In a preferred arrangement, the second end of the first component is insertable into the first end of the second component.

It is a primary object of the invention to provide a discharge hose adapter that obviates the problems noted above, enabling discharge of the boat holding tank into a dump station.

This and other objects and advantages of the present invention will become apparent in view of the following detailed description of the drawings and appended claims.

BRIEF DESCRIPTION OF THE DRAWINGS

FIG. 2 is a side cross-sectional view of a standard marine 1½ inch thru hull fitting;

FIG. 3 is an exploded view of the discharge hose adapter according to the invention; and FIG. 4 is a side cross-sectional view of the discharge hose adapter of FIG. 3 with the components assembled.

DETAILED DESCRIPTION OF THE DRAWINGS

Figure 1:
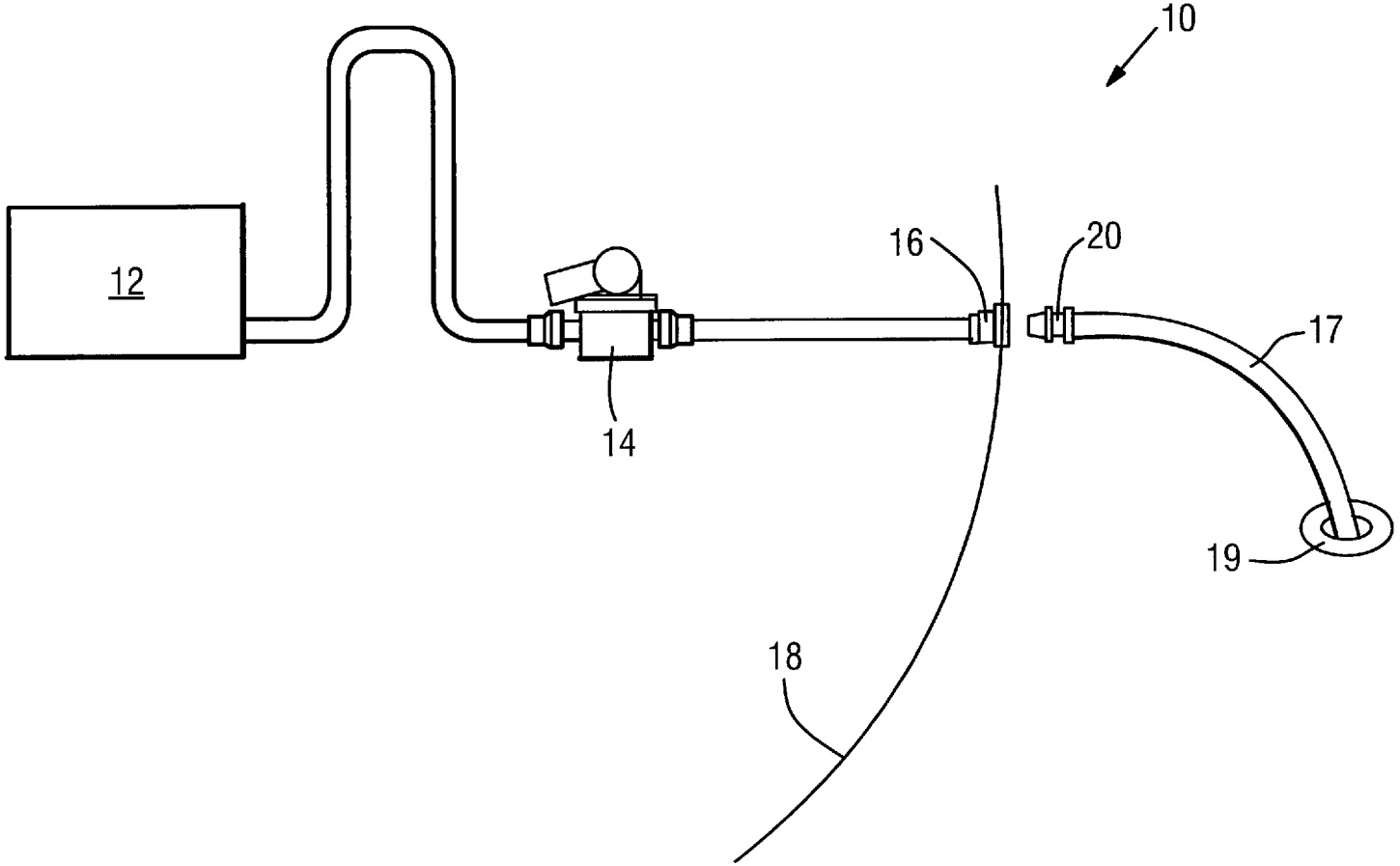
FIG. 1 schematically illustrates a boat holding tank system.

In accordance with the present invention, a discharge hose adapter is provided that allows the owner of a boat to empty the boat holding tank into, for example, an RV dump station. This allows the boat owner to empty the holding tank at any time and usually at no cost, with the boat still on the trailer.

FIG. 1 illustrates a boat holding tank system 10. The system includes a holding tank 12, a pump 14 and a thru hull fitting 16. Typically, the thru hull fitting 16 extends out boat hull 18 and is engageable with a boat pump out station. FIG. 2 illustrates a standard 1½ inch marine thru hull fitting 16.

With continued reference to FIG. 1, a discharge hose adapter 20 according to the present invention is engageable with the standard thru hull fitting 16 at one end and to a standard flexible reinforced sanitation hose 17 at its other end. The hose 17 is used for discharging the contents of the holding tank 12 into a dump station 19.

FIG. 3 is an exploded view of the discharge hose adapter according to the invention. The adapter 20 includes a first component 22 that is engageable at a first end 24 with the standard marine thru hull fitting 16. A second end 26 of the first component 22 is engageable with a first end 28 of the second component 23. The first component 22 is preferably PVC injection molded plastic. In a preferred embodiment, the first end 24 of the first component 22 can be press fit over the end of the thru hull fitting 16 extending from the boat hull 18. Of course, those of ordinary skill in the art will contemplate alternatives for the engagement between the adapter 20 and the thru hull fitting 16, and the invention is not meant to be limited to the embodiment that is illustrated and described. The engagement between the first end 24 of the first component 22 and the thru hull fitting 16 is configured to remain secured to at least 18 psi of back pressure. The pressure 18 psi is significant because that is the maximum back pressure that a pump can typically operate against before pump failure. The discharge connection 22, 24 can typically sustain higher pressures, but it is unlikely that the back pressure will ever exceed a few psi. The discharge is operating at open flow, thus no back pressure should develop. Lower pressures have no impact on the integrity of the union.

The second component 23 is preferably formed of compression molded rubber derived from vinyl monomers and has a first enlarged end 28 that is bonded to the second end 26 of the first component 22. The bond between components 26 and 28 is created by a conventional chemical adhesion. No heat is required. The material of both components are compatible for gluing together permanently using a wide variety of conventional glues. A second end 30 of the second component 23 is adapted to engage the flexible reinforced sanitation hose 17, which can be stored on the trailer for the boat having hull 18. FIG. 4 illustrates the first component 22 and the second component 23 engaged to form the discharge hose adapter of the present invention.

Once the adapter 20 is inserted into the thru hull fitting 16 and the hose 17 is in the dump station opening 19, the boat owner can activate the boat's discharge pump 14 and empty the holding tank 12. Because the adapter 20 is preferably designed to work on a friction fit, the adapter does not require any fasteners. In operation, the adapter 20 is secured to the thru hull fitting 16 with a conventional hose clamp (not shown), and comprises means for adapting a standard marine thru-hull fitting 16 to a standard sanitation hose 17, enabling ready discharge of a boat holding tank 12 into a dump station 19.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A boat holding tank system comprising:

a holding tank, a pump connected to the holding tank;

a standard marine thru hull fitting;

a conduit connecting said pump and holding tank to said fitting;

a sanitation hose; and a discharge hose adapter comprising: a first component having a first end and a second end, said first end being frictionally engaged with said standard marine thru hull fitting; and a second component having a first end engageable with said second end of said first component and a second end engageable with said sanitation hose.

2. A system adapter according to claim 1, wherein said first component is PVC injection molded plastic.

3. A system adapter according to claim 1, wherein said first component is press fittable with the marine thru hull fitting.

4. A system according to claim 1, wherein said first end is frictionally engaged with said standard marine thru hull fitting so as to remain secured to at least 18 psi of back pressure.

5. A system adapter according to claim 1, wherein said second component is compression molded rubber derived from vinyl monomers.

6. A system adapter according to claim 5, wherein said second component is bonded to the first component.

7. A system according to claim 5, wherein said first component is press with said marine thru hull fitting.

8. A system adapter according to claim 1, wherein said second component is bonded to the first component.

9. A system adapter according to claim 1, wherein said second end of said first component is insertable into said first end of said second component.

10. A system according to claim 1 wherein said marine thru hull fitting comprises a standard one and one-half inch marine thru hull fitting.

11. A system according to claim 1 wherein said sanitation hose is connected to a dump station.

12. A system adapter according to claim 2, wherein said second component is bonded to the first component.

13. A system according to claim 2, wherein said first component is press fit with said marine thru hull fitting.

14. A system adapter according to claim 2, wherein said second component is compression molded rubber derived from vinyl monomers.

15. A system according to claim 14 wherein said first end is frictionally engaged with said standard marine thru hull fitting so as to remain secured to at least 18 psi of back pressure.

16. A system according to claim 14, wherein said first component is press fit with said marine thru hull fitting.

17. A discharge hose adapter according to claim 14, wherein said second component is bonded to the first component.

18. A system adapter according to claim 17 wherein said second component is bonded to said first component by chemical adhesion without application of heat.

* * * * *